US005934261A

United States Patent [19]

Schumann et al.

[11] Patent Number: 5,934,261

[45] Date of Patent: Aug. 10, 1999

[54] ELECTRODE FOR ELECTROSTATIC FILTER

[75] Inventors: Heiko Schumann, Münster; Stefan Ahlborn, Senden, both of Germany

[73] Assignee: Ing. Walter Hengst GmbH & Co., Münster, Germany

[21] Appl. No.: 09/007,841

[22] Filed: Jan. 15, 1998

[30] Foreign Application Priority Data

Jan. 17, 1997 [DE] Germany ..... 197 01 463

[51] Int. Cl.[6] ..... F01M 1/00

[52] U.S. Cl. ..... 123/573

[58] Field of Search ..... 123/572, 573, 123/574

[56] References Cited

U.S. PATENT DOCUMENTS 3,976,448 8/1976 Eng et al. ..... 123/572

FOREIGN PATENT DOCUMENTS 0 685 635 5/1995 European Pat. Off. .
33 24 803 6/1991 Germany .

*Primary Examiner*—Marguerite McMahon
*Attorney, Agent, or Firm*—Lahive & Cockfield, LLP

[57] ABSTRACT

In an oil separator designed as an electrostatic filter with a one-piece discharge electrode and a collecting electrode, said separator being located in the vent line of a crankcase ventilation system for an internal combustion engine, the invention proposes that the spray electrode be made in two stages, with a first stage having a small cross-sectional area and a second stage having a cross-sectional area that is larger than that of the first, and with the spray electrode tapering from the cross-sectional area of its second stage to the smallest cross-sectional area of its first stage, and with the first stage being made in the shape of a cone and having a base that adjoins the second stage and a freely terminating tip.

5 Claims, 1 Drawing Sheet

ELECTRODE FOR ELECTROSTATIC FILTER

BACKGROUND OF THE INVENTION

The invention relates to an electrode.

A one-piece electrode of this type is known from EP 685 635 A1. The small diameter of the thin rod or wire used as the spray electrode provides limited insensitivity to vibrations.

Devices not according to the species, in which electrostatic filters are provided for precipitating dust, can be found for example in DE 33 24 803 C2 and FR 1 050 120. FR 944 547 also relates to an electrostatic filter. In all of the filters that do not belong to the species, a thin wire is provided that serves to ionize the particles to be precipitated. The crankcase ventilation system according to the species also proposes a wire, rod, or thin tube as the spray electrode, with the spray electrode being mounted at both ends.

The known electrodes that do not belong to the species are designed with two or more parts.

DE 33 24 803 C2 teaches a wire connected with a tube. Both parts together form the spray electrode. The subject of FR 944 547 teaches a wire connected with a cylinder. Optionally, the electrode section formed by the wire can be provided with a plurality of disks to intensify ionization.

FR 1 050 120 teaches a wire connected with a projection.

This design of the electrodes with two or more parts has a disadvantageous influence on sensitivity to vibration and on manufacturing cost.

An object of the invention is to improve extensively on an electrode according to the species so that the oil separator can be manufactured as economically as possible, has an insensitivity to vibration that is as great as possible, and has a low power requirement.

SUMMARY OF THE INVENTION

This goal, which forms the basis of the invention, is achieved by an electrode having a larger cross-sectional end or stage that tapers toward a smaller cross-sectional stage.

In other words, the invention proposes providing an oil separator with a two-stage spray electrode, with the term "two-stage" according to the invention being understood to mean that the spray electrode has two sections with cross-sectional areas of different sizes so that two areas with different field line densities are produced. Firstly, there is a first stage with a small cross-sectional area, in other words with a high field line density, so that a corona forms in which the particles to be precipitated are ionized. The second stage, with a larger cross-sectional area, serves merely for electrostatic precipitation of the charged particles.

The fact that the spray electrode does not form a corona over its entire length means that it has a lower power requirement but a level of efficiency that is not reduced to the same degree, so that the efficiency based on the applied power is better than that achieved with a spray electrode that is made thin and uniform throughout.

In contrast to conventional multiple part electrodes that are used for dust precipitation, the one-piece electrode according to the invention has a considerably improved resistance to vibration so that it guarantees a high operating reliability. In addition, the one-piece electrode can be manufactured more economically since the assembly costs of a multipartite design are eliminated.

The spray electrode and collecting electrode can be made rotationally symmetrical. This favors uniform field-line and operating conditions in the oil separator as well as economical manufacture of the electrodes.

Especially advantageously, the spray electrode can have an area forward of the first stage that is in the form of a pointed cone, followed by an area with a larger diameter for the second stage. This permits an especially sturdy and vibration-resistant design, with the electrical field forming at the free pointed end of the first stage, which has the shape of a pointed cone, surprisingly sufficing for ionization of the particles to be precipitated in order to guarantee good precipitation performance.

Advantageously, the free end of the first stage can be made pointed or sharp-edged in order to produce a high field line density and thus improve the performance of the oil separator. Rounding this free end does not adversely affect the basic ability of the oil separator to function but it does reduce its performance.

Additional advantageous embodiments of the invention will be described in connection with the accompanying drawings and the description set forth below.

DESCRIPTION OF ILLUSTRATED EMBODIMENTS

An embodiment of a crankcase ventilation system according to the invention will be described in greater detail below with reference to the drawing.

BRIEF DESCRIPTION OF THE DRAWINGS

In FIG. 1, 1 refers to a vent line through which gases containing oil flow from left to right in the drawing. The gases enter an oil separator 2 designed as an electrostatic filter, in which three separating chambers 3 are provided, distributed around the circumference. Each separation chamber 3 has a housing 4 with a cylindrical inside wall that serves as a collecting electrode, with a spray electrode 5 being located centrally in housing 4. Spray electrode 5 has a first stage 6 in the form of a pointed cone as well as a second cylindrical stage 7. A corona forms at the freely terminating tip of the first stage and the oil particles in the gas stream that are ionized therein are guided in the vicinity of the first stage and especially in the longer area of the second stage by their electrical charge to the collecting electrode, namely to housing 4. They collect on the housing wall and fall down into a collecting chamber 8, from which the separated oil flows into a crankcase 9 shown schematically.

Figure 1:
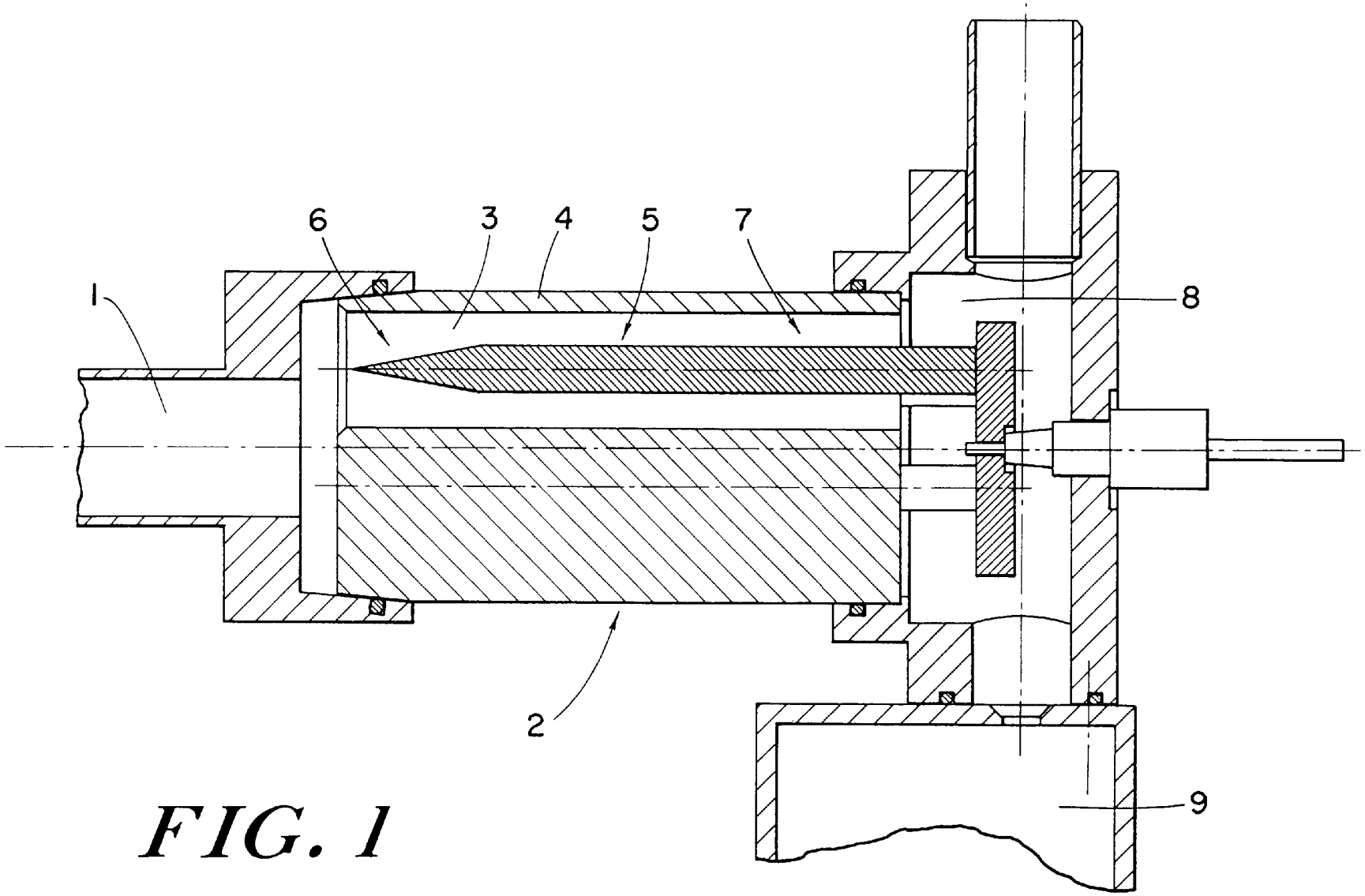
FIG. 1 illustrates in partial cross-section an oil separator employing the electrode according to the teachings of the present invention.

The inside diameter of housing 4 is approximately 2.5 times larger than the outside diameter of second stage 7 of spray electrode 5. This diameter ratio of 2.5 (or cross-sectional area ratio of 6.25) simultaneously permits good precipitation performance, a comparatively low power draw, compact structural dimensions, as well as a favorable ratio of the operating voltage to the sparkover voltage of the oil separator, but operation is also possible with diameter ratios of 1.2 to 10 (or cross-sectional area ratios of 1.44 to 100).

The efficiency of the entire design of oil separator 2 is supported by the parallel arrangement of a plurality of precipitation chambers 3, three in the embodiment shown.

The resistance to vibration of spray electrode 5 shown in the diagram is especially improved by the fact that no stepped changes in cross section are provided that could lead to voltage peaks in the material of release electrode 5.

Instead, a constant transition in cross section, which is linear in the embodiment that is shown purely as an example, from the base of first stage 6 to its freely terminating tip, with the diameter of the base being equal to the diameter of second stage 7.

Because spray electrode 5 has a diameter that is larger than a wire that forms the corona over much of its length, and thus allows it to be mounted at only one end, the second mount that is required for spray electrodes according to the species is eliminated. The danger of leakage currents propagating in the event of contamination of an electrode mount is thus reduced by more than 50% and the operating safety of the oil separator is correspondingly improved, one of the two mounts that would otherwise be required is eliminated, and the remaining mount is located in the area of the already scrubbed gas stream where the number of particles is already small.

The concentric arrangement of spray electrode 5 in housing 4 ensures a uniform flow path around spray electrode 5 and thus ensures a uniform separating power around spray electrode 5 as well as a flow of the gas containing the oil particles that is disturbed as little as possible.

The comparatively solid design of spray electrode 5 as shown permits its reliable and economical manufacture by casting, forging, or turning for example.

Advantageously, a tip or sharp edge is provided for reliable formation of a sufficiently ionizing corona.

I claim:

1. A crankcase ventilation system for an internal combustion engine employing an oil separator designed with a one-piece discharge electrode and a collecting electrode and located in a vent line of the crankcase ventilation system, said ventilation system comprising a spray electrode (5) designed with a first stage (6) having a small cross-sectional area and a second stage (7) having a cross-sectional area that is larger than the first cross sectional area, said spray electrode (5) tapering from the cross-sectional area of the second stage (7) to the smallest cross-sectional area of the first stage (6), wherein said first stage (6) has a conical shape, a base adjoining the second stage (7), and a freely terminating tip.

2. Crankcase ventilation system according to claim 1, comprising a plurality of oil separators (2) connected in parallel in the vent line (1).

3. Crankcase ventilation system according to claim 1, wherein the spray electrode (5) is located axially in the collecting electrode (4), said collecting electrode having a tubular shape.

4. Crankcase ventilation system according to claim 3, wherein the collecting electrode has an internal cross-sectional area that is 1.4 to 100 times larger than the cross-sectional area of the second stage (7) of the spray electrode (5).

5. Crankcase ventilation system according to claim 1, wherein the free end of the first stage (6) comprises a pointed or sharp-edge.

* * * * *